US011747755B2

(12) United States Patent
Maruyama

(10) Patent No.: US 11,747,755 B2
(45) Date of Patent: Sep. 5, 2023

(54) IMAGE FORMING APPARATUS HAVING CONTROLLER FOR SETTING COOLING THRESHOLD ACCORDING TO SHEET SIZE

(71) Applicant: BROTHER KOGYO KABUSHIKI KAISHA, Nagoya (JP)

(72) Inventor: Yasuhiro Maruyama, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/720,445

(22) Filed: Apr. 14, 2022

(65) Prior Publication Data

US 2022/0334527 A1 Oct. 20, 2022

(30) Foreign Application Priority Data

Apr. 14, 2021 (JP) ..... 2021-068099

(51) Int. Cl.
*G03G 15/20* (2006.01)
*G03G 15/00* (2006.01)
*G03G 21/20* (2006.01)

(52) U.S. Cl.
CPC ..... *G03G 15/2017* (2013.01); *G03G 15/2042* (2013.01); *G03G 15/2046* (2013.01); *G03G 15/6588* (2013.01); *G03G 21/206* (2013.01); *G03G 15/2039* (2013.01); *G03G 2215/00734* (2013.01); *G03G 2215/00772* (2013.01); *G03G 2221/1645* (2013.01)

(58) Field of Classification Search
CPC ..... G03G 15/6588; G03G 15/2017; G03G 15/2042; G03G 15/2046; G03G 21/206; G03G 2215/2045; G03G 2215/00734; G03G 2215/00772; G03G 2221/1645
USPC ..... 399/33, 67, 68, 389
See application file for complete search history.

(56) References Cited

U.S. PATENT DOCUMENTS 5,550,621 A * 8/1996 Ogawahara ..... G03G 15/2042 399/92
8,670,703 B2 * 3/2014 Mihara ..... B41J 13/0018 399/389
2012/0056970 A1 * 3/2012 Miwa ..... G03G 15/6564 347/264

(Continued)

FOREIGN PATENT DOCUMENTS

JP 2002296933 A 10/2002
JP 2003076171 A 3/2003
JP 2011085802 A 4/2011

*Primary Examiner* — Robert B Beatty
(74) *Attorney, Agent, or Firm* — Scully, Scott, Murphy & Presser, PC

(57) ABSTRACT

An image forming apparatus includes a controller configured to identify a selected sheet size setting as defined by a dimension in the width direction and a dimension in the conveyance direction, set a cooling threshold at a first threshold if the selected sheet size setting is a first size having a dimension in the width direction larger than a predetermined dimension, and a dimension in the conveyance direction larger than the dimension in the width direction, and set the cooling threshold at a second threshold lower than the first threshold if the selected sheet size setting is a second size having a dimension in the width direction that is the same as the dimension in the width direction of the first size, and a dimension in the conveyance direction smaller than the dimension in the width direction.

15 Claims, 5 Drawing Sheets

NORMAL FIXING MODE

| SHEET SIZE | CONVEYANCE SPEED | TARGET TEMPERATURE TT | COOLING THRESHOLD TH |
|---|---|---|---|
| LETTER (PORTRAIT) A4 (PORTRAIT) | FULL SPEED | TT1(HIGH) | TH1(HIGH) |
| A5 (LANDSCAPE) | FULL SPEED | TT2(MEDIUM) | TH2(MEDIUM) |
| A6 (PORTRAIT) | HALF SPEED | TT3(LOW) | TH1(HIGH) |

(56) References Cited

U.S. PATENT DOCUMENTS

| | | | | |
|---|---|---|---|---|
| 2013/0183059 | A1* | 7/2013 | Yokokawa | G03G 21/206 399/92 |
| 2014/0056629 | A1* | 2/2014 | Obata | G03G 15/6529 399/389 |
| 2014/0321873 | A1* | 10/2014 | Kadowaki | G03G 15/2042 399/92 |
| 2015/0316879 | A1* | 11/2015 | Koyama | G03G 15/2039 399/69 |
| 2018/0157003 | A1* | 6/2018 | Tsuchihashi | G03G 15/2042 |
| 2019/0049880 | A1* | 2/2019 | Hagiwara | G03G 15/20 |
| 2021/0011409 | A1* | 1/2021 | Sakamoto | G03G 15/50 |

* cited by examiner

FIG.4A

NORMAL FIXING MODE

| SHEET SIZE | CONVEYANCE SPEED | TARGET TEMPERATURE TT | COOLING THRESHOLD TH |
|---|---|---|---|
| LETTER (PORTRAIT)<br>A4 (PORTRAIT) | FULL SPEED | TT1(HIGH) | TH1(HIGH) |
| A5 (LANDSCAPE) | FULL SPEED | TT2(MEDIUM) | TH2(MEDIUM) |
| A6 (PORTRAIT) | HALF SPEED | TT3(LOW) | TH1(HIGH) |

FIG.4B

HIGH-TEMPERATURE FIXING MODE

| SHEET SIZE | CONVEYANCE SPEED | TARGET TEMPERATURE TT | COOLING THRESHOLD TH |
|---|---|---|---|
| LETTER (PORTRAIT)<br>A4 (PORTRAIT) | FULL SPEED | TT4(HIGH) | TH2(MEDIUM) |
| A5 (LANDSCAPE) | FULL SPEED | TT5(MEDIUM) | TH3(LOW) |
| A6 (PORTRAIT) | HALF SPEED | TT6(LOW) | TH2(MEDIUM) |

TT4>TT1
TT5>TT2
TT6>TT3

IMAGE FORMING APPARATUS HAVING CONTROLLER FOR SETTING COOLING THRESHOLD ACCORDING TO SHEET SIZE

CROSS-REFERENCE TO RELATED APPLICATION(S)

This application claims priority from Japanese Patent Application No. 2021-068099 filed on Apr. 14, 2021, the disclosure of which is incorporated herein by reference in its entirety.

TECHNICAL FIELD

The present disclosure relates to an image forming apparatus that thermally fixes a toner image on a sheet.

BACKGROUND ART

An image forming apparatus conventionally known in the art includes a heating member for thermally fixing a toner image on a sheet. If a sheet with a narrow width is used in such an apparatus, heat will not be absorbed and dissipated at end portions of the heating member in the width direction. This may result in a rise in temperature at the end portions. Various measures are being considered, as suitable for a selected sheet size setting in a printing job and a size of a sheet actually fed, to restrain an abnormal rise in temperature of the heating member.

A conventional image forming apparatus includes a sheet sensor capable of detecting a dimension of a sheet in a conveyance direction thereof, but sometimes does not include a sensor for detecting a dimension of the sheet in a width direction thereof to keep down the cost. In such a case, if the image forming apparatus receives a printing job with a setting of, for example, an A5 sheet to be fed in a landscape (sideways) orientation, but the sheet actually fed is an A6 sheet in a portrait (endways) orientation, it cannot be detected that a sheet of a different size has been fed since an A5 sheet fed in a landscape orientation and an A6 sheet fed in a portrait orientation have the same length in the conveyance direction. However, an A6 sheet fed in a portrait orientation has a dimension in the width direction smaller than that of an A5 sheet fed in a landscape orientation. Therefore, the temperature at the end portions of the heating member would rise if no measures were taken.

SUMMARY

A possible approach to the above situation may be to set a conveyance speed at a lower speed when a printing job with a setting of an A5 sheet to be fed in a landscape orientation is received, in order to prevent a rise in temperature at the end portions of the heating member. This will result in reduction of a printing speed, contrary to a prevalent need to minimize the slowdown of the conveyance speed.

It would be desirable to provide an image forming apparatus that can restrain temperature rise at the end portions of the heating member without unnecessarily reducing the conveyance speed.

In one aspect, an image forming apparatus disclosed herein comprises a feed roller that feeds a sheet having a width oriented in a width direction perpendicular to a conveyance direction of the sheet; a process unit that forms a toner image on the sheet fed from the feed roller; a fuser that heats and fixes the toner image formed on the sheet; and a controller.

The fuser comprises a heating member; a pressure member that nips a sheet with a toner image formed thereon in combination with the heating member; and a temperature sensor that detects a temperature of an end portion of the heating member which is one of two end portions thereof positioned apart from each other in the width direction.

The controller is configured to execute a printing process by controlling the feed roller, the process unit, and the fuser; execute, if a temperature detected by the temperature sensor becomes equal to or higher than a cooling threshold during execution of the printing process, a cooling process to restrain a rise in temperature of the heating member; set the cooling threshold at a first threshold if a selected sheet size setting as defined by a dimension in the width direction and a dimension in the conveyance direction is a first size having a dimension in the width direction larger than a predetermined dimension, and a dimension in the conveyance direction larger than the dimension in the width direction; and set the cooling threshold at a second threshold lower than the first threshold if the selected sheet size setting is a second size having a dimension in the width direction that is the same as the dimension in the width direction of the first size, and a dimension in the conveyance direction smaller than the dimension in the width direction.

BRIEF DESCRIPTION OF THE DRAWINGS

The above and other aspects, their advantages and further features will become more apparent by describing in detail illustrative, non-limiting embodiments thereof with reference to the accompanying drawings, in which:

FIG. 4A is a table showing the settings of a normal fixing mode;

FIG. 4B is a table showing the settings of a high-temperature fixing mode.

DESCRIPTION OF EMBODIMENTS

A detailed description will be given of a non-limiting embodiment with reference made to the drawings where appropriate.

Figure 1:
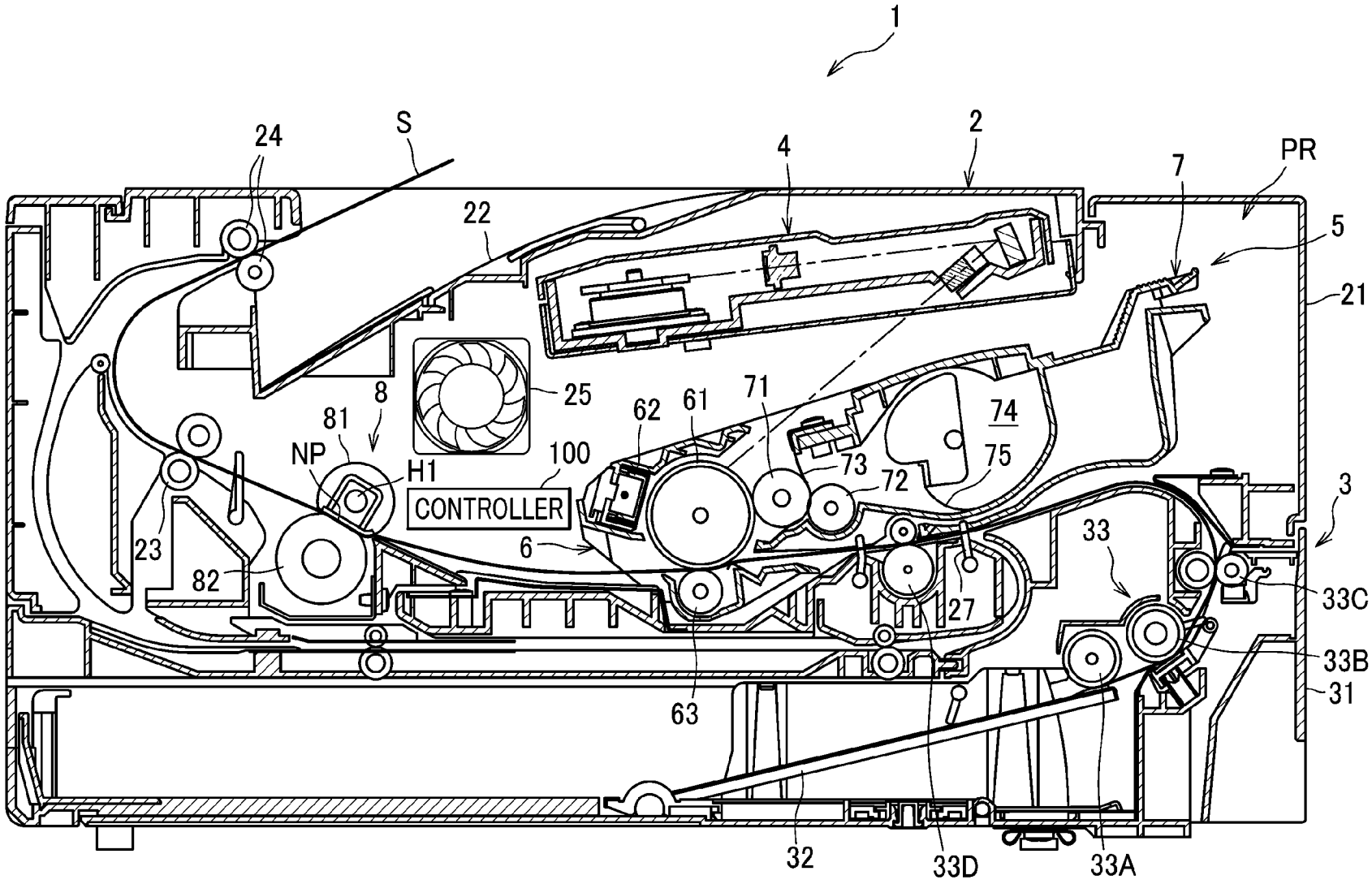
FIG. 1 is an illustration showing a laser printer.

As shown in FIG. 1, an image forming apparatus 1 is a laser printer for forming an image on a sheet S. The image forming apparatus 1 comprises a housing 2, a feeder unit 3, a process unit PR, a fuser 8, and a controller 100.

The housing 2 comprises a fan 25 for ventilating the housing 2. The controller 100 controls the operation and operation speed of the fan 25.

The feeder unit 3 is a mechanism for feeding a sheet S to the process unit PR and is arranged in a lower space within the housing 2. The feeder unit 3 comprises a sheet tray 31 that holds sheets S, a sheet pressing plate 32, and a feeding mechanism 33. The feeding mechanism 33 includes a pick-up roller 33A, a separator roller 33B, a first conveyor roller 33C as an example of a feed roller, and a register roller 33D. The sheets S in the sheet tray 31 are pressed against the pick-up roller 33A by the sheet pressing plate 32 and fed by the pick-up roller 33A to the separator roller 33B. The sheets S are separated one from others by the separator roller 33B and conveyed one by one by the first conveyor roller 33C. The register roller 33D aligns a leading edge of each sheet S, and then conveys each sheet S to the process unit PR. In this description, a direction of conveyance of a sheet S is referred to simply as "conveyance direction", and a direction perpendicular to the conveyance direction and parallel to the surfaces of the sheet S being conveyed is referred to simply as "width direction".

A sheet sensor 27 is provided upstream of the register roller 33D in the conveyance direction of a sheet S. The sheet sensor 27 detects presence or absence of a sheet S fed from the feeder unit 3 and passing therethrough. The sheet sensor 27 comprises an actuator that swings when pressed by the sheet S, and an optical sensor capable of detecting a motion of the actuator. The sheet sensor 27 is configured to be capable of detecting whether or not a sheet S is present at the sheet sensor 27 by the optical sensor detecting the motion of the actuator. The sheet sensor 27 is located at a position in the width direction through which all sizes of sheets usable as a medium for image forming in the image forming apparatus 1 pass. If the image forming apparatus 1 is, for example, configured to convey sheets S near a center thereof in the width direction, the sheet sensor 27 may be located in the center or near the center of the image forming apparatus 1 in the width direction. The controller 100 receives signals from the optical sensor of the sheet sensor 27. The controller 100 is capable of calculating a dimension of a sheet S in the conveyance direction based on a period of time the sheet sensor 27 detects a sheet S passing therethrough. In this description, the dimension of a sheet S in the conveyance direction is also referred to simply as "sheet length".

The process unit PR has a function of forming a toner image on a sheet S fed from the feeder unit 3. The process unit PR comprises an exposure device 4 and a process cartridge 5.

The exposure device 4 is provided in an upper space within the housing 2, and comprises a laser light source (not shown), a polygon mirror, lenses, a reflector (shown with reference characters omitted), etc. The exposure device 4 is configured such that a laser light based on image data is emitted from the laser light source to rapidly scan a surface of a photoconductor drum 61 and thereby expose the surface of the photoconductor drum 61 to light.

The process cartridge 5 is provided below the exposure device 4, and configured to be installable into and removable from the housing 2 through an opening formed when a front cover 21 of the housing 2 is opened. The process cartridge 5 comprises a drum unit 6 and a development unit 7.

The drum unit 6 includes the photoconductor drum 61, a charger 62, and a transfer roller 63. The development unit 7 is installable into and removable from the drum unit 6, and includes a development roller 71, a supply roller 72, a doctor blade 73, a toner container 74, and an agitator 75. The toner container 74 contains dry toner as an example of toner.

In the process cartridge 5, the surface of the photoconductor drum 61 is uniformly charged by the charger 62 and thereafter exposed to laser light emitted from the exposure device 4 to form an electrostatic latent image on the surface of the photoconductor drum 61 based on image data. Toner in the toner container 74, being agitated by the agitator 75, is supplied to the development roller 71 via the supply roller 72, enters the space between the development roller 71 and the doctor blade 73 as the development roller 71 rotates, and is carried on the development roller 71 as a thin layer with a uniform thickness.

The toner carried on the development roller 71 is supplied to the electrostatic latent image formed on the surface of the photoconductor drum 61. As a result, the electrostatic latent image is visualized and a toner image is formed on the photoconductor drum 61. Subsequently, when the sheet S fed from the feeder unit 3 is conveyed through between the photoconductor drum 61 and the transfer roller 63, the toner image formed on the surface of the photoconductor drum 61 is transferred onto the sheet S.

The fuser 8 is a device for heating, and fixing on a sheet, a toner image formed on the sheet S in the process unit PR. The fuser 8 comprises a heating member 81 that heats a sheet S, and a pressure member 82 that nips a sheet with a toner image formed thereon in combination with the heating member 81.

The heating member 81 is a rotatable endless belt and comprises a substrate made of metal, plastic or the like, and a release layer that covers an outer peripheral surface of the substrate. The heating member 81 includes a heater H1 that heats the heating member 81 and a nip plate NP, both arranged inside the heating member 81.

The heater H1 is a halogen lamp which, when energized, generates light and heat, and heats the heating member 81 by radiant heat. The heater H1 is arranged along a rotation axis of the heating member 81.

The pressure member 82 is a rotatable pressure roller and comprises an elastic layer made of elastically deformable rubber or the like provided on an outer peripheral surface thereof. The nip plate NP is a plate-shaped member that receives radiant heat from the heater H1. The nip plate NP is arranged in such a manner that an inner circumferential surface of the heating member 81 slidably contacts a lower surface of the nip plate NP. The nip plate NP nips the heating member 81 in combination with the pressure member 82. The fuser 8 thermally fixes a toner image on a sheet S as the sheet S with the toner image transferred thereon is conveyed through between the heating member 81 and the pressure member 82. The sheet S with the toner image thermally fixed thereon is ejected onto an output tray 22 by a second conveyor roller 23 and an ejection roller 24.

Figure 2:
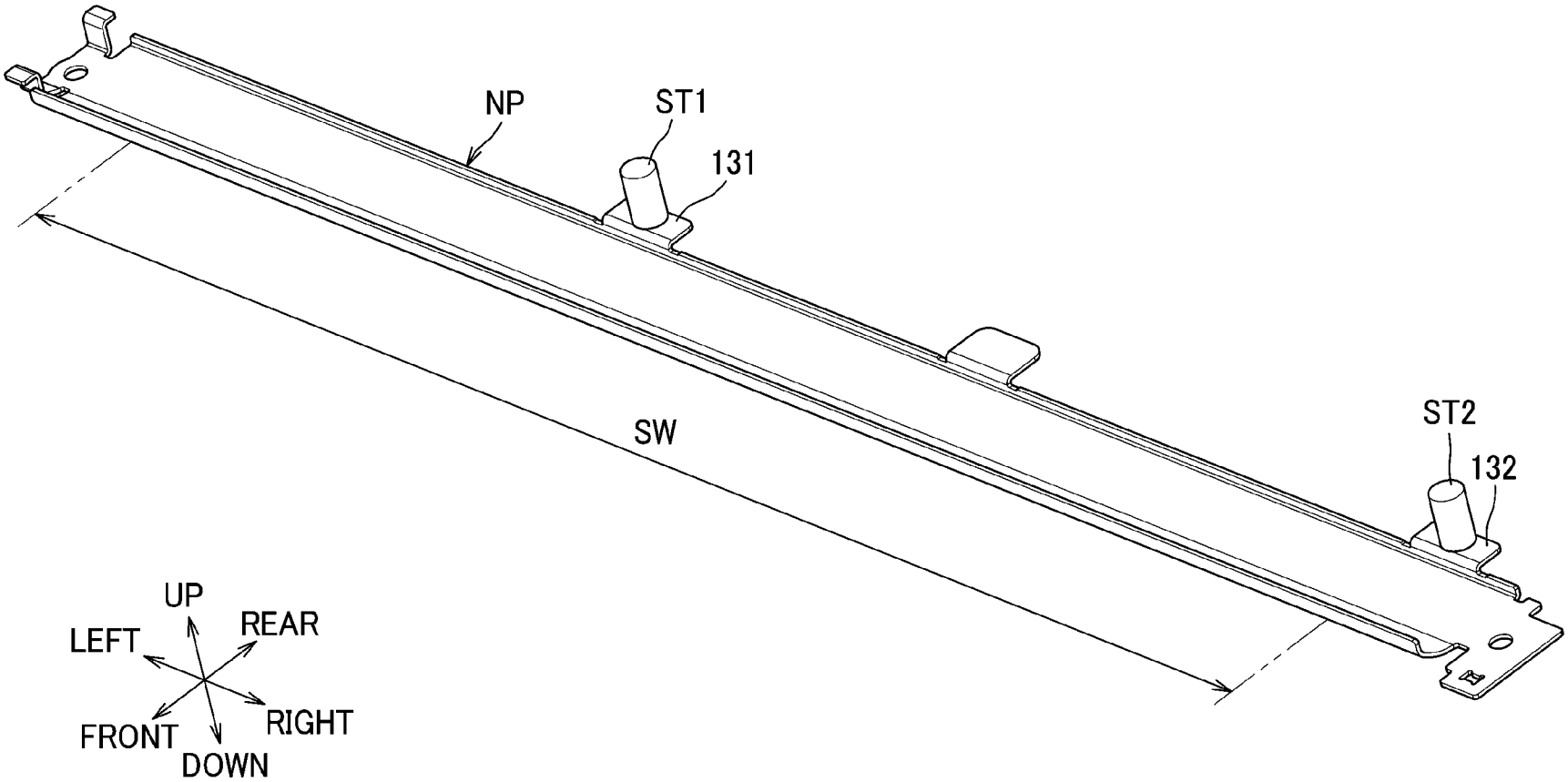
FIG. 2 is an illustration of a heater of a fuser.

As shown in FIG. 2, the nip plate NP has two end portions positioned apart from each other in the width direction and a central portion positioned between the two end portions. The nip plate NP comprises a central detection portion 131 and an end detection portion 132 both protruding from an edge of the sheet S in the conveyance direction. The central detection portion 131 is located at the central portion. The end detection portion 132 is located at one end portion. A central temperature sensor ST1 is arranged to face the central detection portion 131. An end temperature sensor ST2 is arranged to face the end detection portion 132.

The central temperature sensor ST1 detects a temperature T1 of the central portion of the heating member 81. The central temperature sensor ST1 detects the temperature of the central detection portion 131 of the nip plate NP in a contact or non-contact manner so as to determine the temperature T1 of the central portion of the heating member 81.

The end temperature sensor ST2 detects the temperature T2 of one end portion of the heating member 81. The end temperature sensor ST2 detects the temperature of the end detection portion 132 of the nip plate NP in a contact or non-contact manner so as to determine the temperature T2 of the end portion of the heating member 81. More specifically, the end temperature sensor ST2 is located outside an area SW in which a sheet S can be subjected to a fixing process by the fuser 8 in the width direction. Alternatively, the end temperature sensor ST2 may be located inside the area SW in the width direction.

As the central temperature sensor ST1 and the end temperature sensor ST2, for example, thermistors may be used.

Figure 3:
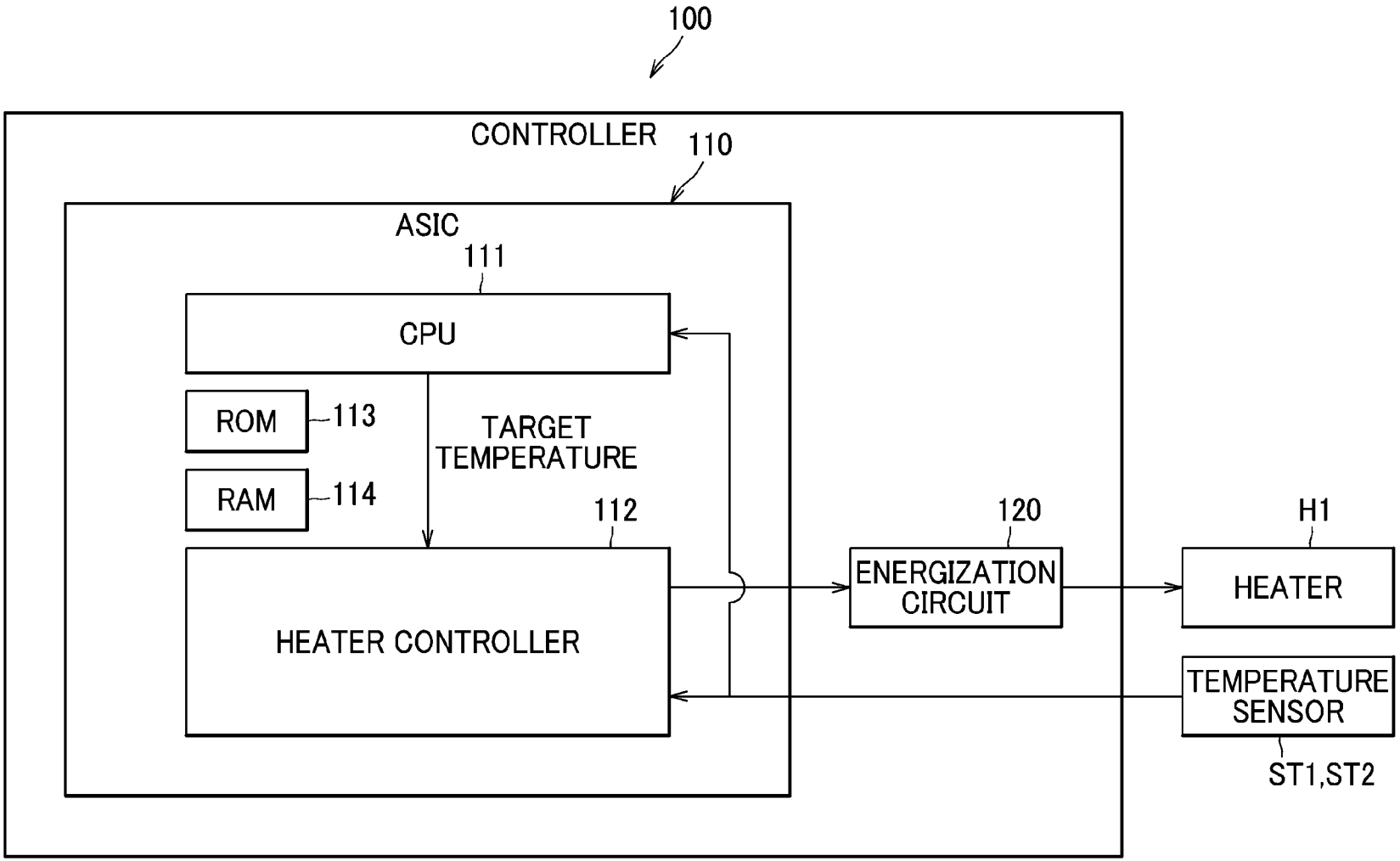
FIG. 3 is a block diagram showing the configuration of a controller.

As shown in FIG. 3, the controller 100 comprises an ASIC 110, and an energization circuit 120. The ASIC 110 includes a CPU 111, a heater controller 112, and memory units such as a ROM 113, a RAM, etc. The energization circuit 120 is connected to the heater H1 and the ASIC 110, and includes a switching circuit, etc., for switching the state of application of an input alternating voltage to selectively energize or de-energize the heater H1.

The CPU 111 is implemented in the ASIC 110 as a function. The CPU 111 outputs a target temperature TT to the heater controller 112. The target temperature TT is a target for a temperature T1 detected by the central temperature sensor ST1. The target temperature TT is a command value in a feedback process in which the heater controller 112 controls energization to the heater H1. The heater controller 112 is a function or circuit implemented in the ASIC 110. The heater controller 112 controls the energization circuit 120 and energizes the heater H1 so that the temperature T1 detected by the temperature sensor ST1 reaches the target temperature TT. More specifically, the heater controller 112 determines a duty cycle of the alternating voltage for energizing the heater based on the temperature T1 detected by the temperature sensor ST1 and the target temperature TT, and executes the feedback process in which the energization circuit 120 is controlled with the determined duty cycle. The feedback process executed by the heater controller 112 may be implemented on a chip outside the ASIC 110 or may be executed by the CPU.

The controller 100 exercises control by executing various arithmetic processing based on a printing job output from an external computer, temperatures T1, T2 detected by the central temperature sensor ST1 and the end temperature sensor ST2, and programs and/or data stored in the memory unit. In other words, the controller 100 operates according to programs and thus functions as a means for exercising various controls.

The controller 100 is configured to execute a printing process by controlling the feeder unit 3, the process unit PR, and the fuser 8. The controller 100 executes a cooling process to restrain a rise in temperature of the heating member 81 if the temperature T2 detected by the end temperature sensor ST2 becomes equal to or higher than a cooling threshold TH during execution of the printing process.

The cooling process includes at least one of processes of temporarily stopping the printing process, reducing a conveyance speed of a sheet S during the printing process, setting a spacing between sheets S conveyed one after another longer during the printing process, activating the fan 25 of the image forming apparatus 1, and increasing an operation speed of the fan 25. More than one of these processes may be performed simultaneously. For example, if the fan 25 is being operated during a printing process where the cooling process is not being executed, the cooling process may be performed by increasing the operation speed of the fan 25 and stopping the printing process for a predetermined period of time. Temporarily stopping the printing process may include stopping the printing process for a predetermined period of time, or stopping the printing process until the temperature T2 becomes lower than a predetermined temperature equal to or lower than the cooling threshold TH. When the printing process is stopped, the fuser 8 drives the heating member 81 and the pressure member 82 at a drive speed lower than that during the printing process. At this point in time, the process unit PR is not driven.

The controller 100 identifies a selected sheet size setting from sheet S information included in a received printing job. The controller 100 sets a target temperature TT for the heating member 81 according to the selected sheet size setting. Herein, the sheet size setting is defined by a width (dimension in the width direction) and a length (dimension in the conveyance direction) of the sheet S. In this disclosure, for example, an A5 sheet fed in a portrait (endways) orientation (oriented in such a manner that it is longer in the conveyance direction than in the width direction) and an A5 sheet fed in a landscape (sideways) orientation (oriented in such a manner that it is shorter in the conveyance direction than in the width direction) are treated as different sizes. In the following description, the description (portrait) or (landscape), which indicates an orientation of a sheet S when fed, is added to identify the size of the sheet S.

The image forming apparatus 1 is capable of printing a sheet of a selected sheet size setting including a first size, a second size, and a third size.

The first size has a dimension in the width direction larger than a predetermined dimension, and a dimension in the conveyance direction larger than the dimension in the width direction.

The second size has a dimension in the width direction that is the same as that of the first size, and a dimension in the conveyance direction smaller than the dimension in the width direction.

The third size has a dimension in the conveyance direction that is the same as that of the second size, and a dimension in the width direction smaller than that of the second size.

In this description, the predetermined width is a width equal to or greater than 90% of a width of a sheet S having a maximum width among sheets S usable in the image forming apparatus 1. For example, if the sheet S having the maximum width among sheets S usable in the image forming apparatus 1 is a letter size (portrait) sheet, the sheet S of the first size includes letter size (portrait) and A4 (portrait) sheets S. Further, in this description, "having a dimension in the width direction that is the same as that of the first size" means that the dimension in the width direction may be different from that of the first size by less than 10%. For example, if the first size includes letter size (portrait) and A4 (portrait), the second size includes A5 (landscape). The width of an A5 (landscape) sheet is the same as the width of an A4 (portrait) sheet, and is approximately 0.97 times the width of a letter size (portrait) sheet. In the following description, as one example, the first size includes A4 (portrait) and letter size (portrait), the second size is A5 (landscape), and the third size is A6 (portrait).

The controller 100 drives a motor (not shown) at full speed or half speed which is half the speed of full speed. The controller 100 changes the conveyance speed of a sheet S by setting the speed of the motor at full speed or half speed. In the following description, the term full speed and half speed is also used to describe the conveyance speed of the sheet S. The controller 100 is configured to execute the printing process in a mode selected from a plurality of modes which comprise a normal fixing mode in which the target temperature TT of the heating member 81 is adjusted to a normal temperature corresponding to the selected sheet size setting, and a high-temperature fixing mode in which a target temperature TT of the heating member 81 is set at a temperature higher than that of the normal fixing mode. The command to execute the printing process in either one of the normal fixing mode or the high-temperature fixing mode is, for example, included in printing job information. The normal fixing mode or the high-temperature fixing mode may be selected from options provided in the printer driver before the user transmits a printing command. If fixing in the normal fixing mode is insufficient, the high-temperature fixing mode may be selected to firmly fix toner on a sheet S. If the printing process is stopped during the cooling process, as described above, the controller 100 sets the motor speed at a speed lower than half speed.

FIGS. 4A and 4B are tables showing parameters corresponding to selected sheet size settings. FIG. 4A shows settings for the normal fixing mode and FIG. 4B shows settings for the high-temperature fixing mode. In the normal fixing mode, if the selected sheet size setting is the first size (A4 (portrait) or letter size (portrait)), the controller 100 sets the conveyance speed of a sheet S at full speed, sets the target temperature TT at a target temperature TT1, and sets the cooling threshold TH at a first threshold TH1. The target temperature TT1 is a relatively high setting of the target temperature TT. The first threshold TH1 is a relatively high setting of the cooling threshold TH. FIGS. 4A and 4B show relative temperature levels of the target temperatures TT and the cooling thresholds TH in the same table by (high), (medium) and (low), just for information. Since A4 is the most frequently printed sheet size in an image forming apparatus in which a maximum usable sheet S is A4 or letter size, the image forming apparatus is optimized for printing an A4 sheet. Thus, if the selected sheet size setting is the first size, the target temperature TT and the cooling threshold TH are set at a high value in order to print at a high speed.

If the selected sheet size setting is the second size (A5 (landscape)), the controller sets the conveyance speed at full speed, i.e., the same speed as that set when the selected sheet size setting is the first size. A second-size sheet may also be printed at a high speed by setting the conveyance speed at full speed.

If the selected sheet size setting is the second size, the controller 100 may set a spacing between sheets S conveyed one after another longer than that when the selected sheet size setting is the first size. For example, if the selected sheet size setting is the first size, the controller 100 sets a spacing between sheets S conveyed one after another at a first spacing, and if the selected sheet size setting is the second size, the controller 100 sets a spacing between sheets S conveyed one after another at a second spacing greater than the first spacing. The controller 100 conveys a plurality of sheets S one after another at a time interval based on the first spacing or the second spacing.

If the selected sheet size setting is the second size, the controller 100 sets the cooling threshold TH at a second threshold TH2 lower than the first threshold TH1. Even if the selected sheet size setting, i.e., the sheet size setting selected by the user included in the printing command, is the second size, the size of the sheet S actually fed is not necessarily the second size. For example, when the selected sheet size setting is the second size, but the sheet S actually fed is a third-size sheet (A6 (portrait)), the temperature at the end portions of the heating member 81 rises because the dimension of the third-size sheet in the width direction is smaller than that of the selected second-size sheet. In such a case, it is possible to start the cooling process earlier and restrain the excessive rise in temperature at the end portions of the heating member 81 by setting the cooling threshold TH at a second threshold TH2.

Further, if the selected sheet size setting is the second size, the controller 100 sets the target temperature TT at a second target temperature TT2. The second target temperature TT2 is a temperature lower than the first target temperature TT1.

If the selected sheet size setting is the third size, the controller 100 sets the conveyance speed at half speed slower than that set when the selected sheet size setting is the second size, sets the target temperature TT at a third target temperature TT3, and sets the cooling threshold TH at the first threshold TH1. The third target temperature TT3 is a temperature lower than the second target temperature TT2. If an A6 (portrait) sheet S which does not conduct heat away from the end portions of the heating member 81 is selected, the conveyance speed is set to half speed to cause the heat in the heating element 81 to transfer from the end portions to the central portion thereof, and the target temperature TT is set at a temperature lower than the second target temperature TT2 for the second size to restrain the rise in temperature at the end portions of the heating member 81. On the other hand, since the conveyance speed and the target temperature TT is set at a low value, the cooling threshold TH is set at the relatively high first threshold TH1 in order to restrain the cooling process from being started unnecessarily.

As shown in FIG. 4B, when the high-temperature fixing mode is selected, the controller 100 sets the target temperature TT at a temperature higher than that of the normal fixing mode. For example, if the selected sheet size setting is the first size, the target temperature TT is set at a fourth target temperature TT4 higher than the first target temperature TT1 of the normal fixing mode. If the selected sheet size setting is the second size, the target temperature TT is set at a fifth target temperature TT5 higher than the second target temperature TT2 of the normal fixing mode. Further, if the selected sheet size setting is the third size, the target temperature TT is set at a sixth target temperature TT6 higher than the third target temperature TT3 of the normal fixing mode.

When the high-temperature fixing mode is selected, the controller 100 sets the cooling threshold TH at a temperature lower than that set as the cooling threshold TH in the normal fixing mode. For example, if the selected sheet size setting is the first size or the third size, the cooling threshold TH is set at a second threshold TH2 lower than the first threshold TH1 of the normal fixing mode. If the selected sheet size setting is the second size, the cooling threshold TH is set at a third threshold TH3 lower than the second threshold TH2 of the normal fixing mode. In this way, for example, if the size of the sheet S actually fed is different from that of the selected sheet size setting, the cooling process may be started earlier to restrain the rise in temperature at the end portions of the heating member 81. If the selected sheet size setting is the second size, the cooling threshold TH may be set at the second threshold TH2, as is the case with the normal fixing mode.

If a dimension LD in the conveyance direction of a sheet S detected by the sheet sensor 27 is smaller than a dimension LS in the conveyance direction as in the selected sheet size setting, the controller 100 causes the sheet S to be conveyed at a conveyance speed slower than that at which a sheet is conveyed when the dimension LD and the dimension LS are equal. If the dimension LD is smaller than the dimension LS, there is a possibility that a width of the sheet S is also small. Thus, the rise in temperature at the end portions of the heating member 81 can be restrained by making the conveyance speed slower. In this disclosure, as one example, if the selected sheet size setting is A4 (portrait) or letter size (portrait), i.e., the first size, and a detected dimension LD in the conveyance direction of the sheet S is smaller than a predetermined value L1, the conveyance speed is changed from full speed to half speed. The predetermined value L1 is a specific threshold for determining if LD<LS is satisfied when the selected sheet size setting is A4 (portrait) or letter size (portrait), and is, for example, smaller than a length of a letter size (portrait) sheet (279.4 mm) and greater than a length of a A5 (portrait) size sheet (210 mm).

Figure 5:
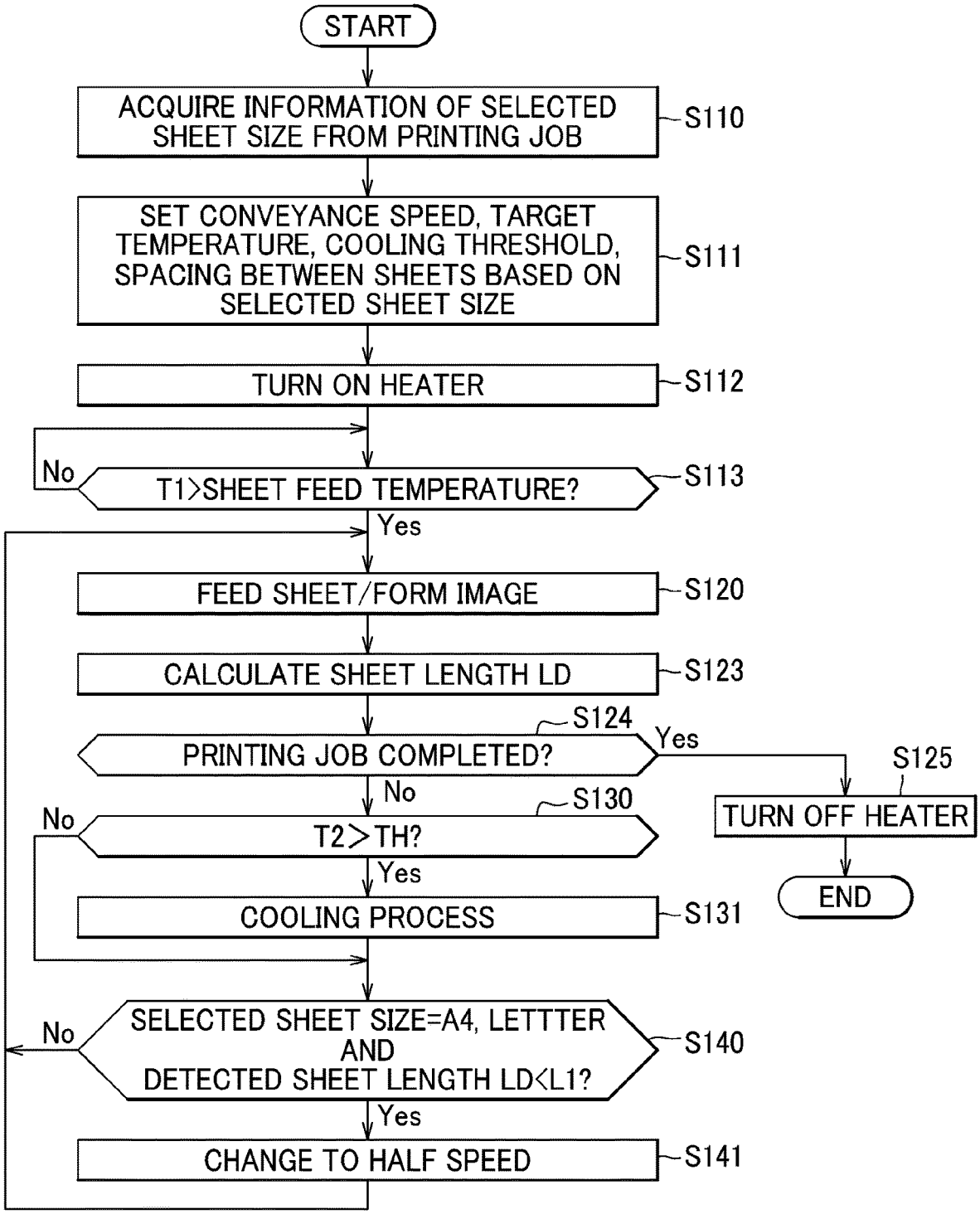
FIG. 5 is a flow chart showing one example of a process executed by the controller.

Next, one example of a process executed by the controller 100 to implement the above-described control will be described in detail. FIG. 5 is one example of a process executed by the controller 100 after receiving a printing job. As shown in FIG. 5, if a printing job is received, the controller 100 acquires information of the selected sheet size setting from the printing job (S110). Then, the conveyance speed, target temperature TT, cooling threshold TH, and spacing between sheets, etc., are set based on the selected sheet size setting (S111).

Subsequently, the controller 100 turns on the heater H1 (S112) and waits until the temperature T1 measured by the central temperature sensor ST1 reaches a sheet feed temperature (S113, No). If the temperature T1 reaches the sheet feed temperature (S113, Yes), the controller 100 causes a sheet S to be fed from the sheet tray 31 to the process unit PR, and an image to be formed on the sheet S (S120). At the point in time when an image has been formed on the sheet S, a trailing edge of the sheet S will have already passed through the sheet sensor 27. The controller 100 computes the dimension LD in the conveyance direction of the sheet S based on the period of time the sheet sensor 27 detects the sheet S passing therethrough (S123).

Then, the controller 100 determines whether or not the printing job has been completed (S124), and if completed (S124, Yes), turns off the heater H1 (S125) and ends the process. On the other hand, if it is determined that the printing job has not been completed (S124, No), the controller 100 determines whether or not the temperature T2 detected by the end temperature sensor ST2 is greater than the cooling threshold TH set according to the selected sheet size setting (S130). If it is determined that the temperature T2 is greater than the cooling threshold TH (S130, Yes), the controller 100 executes the cooling process (S131). In this description, the cooling process includes, for example, stopping the printing process for a predetermined period of time and increasing the operation speed of the fan 25 during that period of time.

If it is determined that the temperature T2 is not greater than the cooling threshold TH in step 130 (S130, No), or if the cooling process in step S131 is finished, the controller 100 determines if the selected sheet size setting is A4 (portrait) or letter size (portrait), i.e., the first size, and if LD<L1 is satisfied (S140). If it is determined that the selected sheet size setting is not A4 (portrait) or letter size (portrait), or LD<L1 is not satisfied, the controller 100 returns to step S120 and executes the image forming process for the next sheet S without changing the conveyance speed to half speed. If it is determined that the selected sheet size setting is A4 (portrait) or letter size (portrait), and LD<L1 is satisfied (S140, Yes), the controller 100 changes the conveyance speed to half speed (S141), and returns to step S120 to execute the image forming process for the next sheet. It is to be understood that it is not possible to change the conveyance speed while an image is being formed on a sheet S being conveyed. Therefore, if a spacing between sheets conveyed one after another is short, the speed of the motor is changed to half speed after an image has been formed on the sheet S being conveyed, and thereafter an image will be formed on the next sheet at half speed.

The image forming apparatus 1 described above can provide the following advantageous effects.

Since the controller 100 sets the cooling threshold TH at a second threshold TH2, lower than the first threshold TH1 as set when the selected sheet size setting is the first size, if the selected sheet size setting is the second size with a dimension in the width direction that is the same as that of the first size, and a dimension in the conveyance direction smaller than the dimension in the width direction, the cooling process can be started earlier when the temperature T2 at the end portions of the heating member 81 start to rise. Thus, the rise in temperature at the end portions of the heating member 81 can be restrained without unnecessarily reducing the conveyance speed in the printing process of the second-size sheet. Further, since the conveyance speed set in the printing process executed when the selected sheet size setting is the second size is the same as a conveyance speed to be set when the selected sheet size setting is the first size, the second-size sheet S can be printed at a fast printing speed.

Since the controller 100 causes a sheet S to be conveyed at half speed if the selected sheet size setting is the third size, the rise in temperature at the end portions of heating member 81 can be reduced during printing of the third-size sheet S.

Since the controller 100 sets the cooling threshold TH at a first threshold if the selected sheet size setting is the third size, the cooling process can be restrained from being executed more than necessary.

Since the controller 100 causes a sheet S to be conveyed at a slower conveyance speed if the dimension LD in the conveyance direction of the sheet S actually fed is smaller than the dimension LS in the conveyance direction of the selected sheet size setting, the rise in temperature at the end portions of the heating member 81 can be restrained proactively.

Since the cooling threshold TH set by the controller 100 when the high-temperature fixing mode is selected is a temperature lower than that to be set in the normal fixing mode, the cooling process can be started earlier when there is a possibility of rise in temperature at the end portions of the heating member 81.

The image forming apparatus described above may be modified and implemented in various other forms as described below.

For example, if the dimension LD in the conveyance direction of a sheet S detected by the sheet sensor 27 is smaller than the dimension LS in the conveyance direction as specified in the selected sheet size setting, the controller 100 may change the spacing between sheets conveyed one after another from the spacing set when the dimension LD and the dimension LS are equal. The rise in temperature at the end portions of the heating member 81 can be restrained by setting a longer spacing as the spacing between sheets conveyed one after another. On the other hand, the printing speed can be increased by setting the spacing between sheets conveyed one after another shorter according to the actual size of the sheets S.

Further, the controller 100 may stop the printing process if the dimension LD in the conveyance direction of a sheet S detected by the sheet sensor 27 is smaller than the dimension LS in the conveyance direction of a selected sheet size setting. In this case, since the size of the sheet actually fed is smaller than the selected sheet size setting, there is a high possibility that the temperature at the ends portions of the heating member 81 will rise. It is possible to prompt a user to select the correct sheet size setting, for example, by stopping printing and providing an error notification on an external computer or a panel of the housing 2, etc.

Although the sheet S with a maximum dimension in the width direction among sheets S usable in the image forming apparatus described in this description is an A4 (portrait) or letter size (portrait) sheet S, the image forming apparatus may be an apparatus in which a sheet S with a maximum dimension in the width direction among sheets S usable therein is an A3 (portrait) sheet. In this case, the first size is A3 (portrait), the second size is A4 (landscape) or letter size (landscape), and the third size is A5 (portrait).

In the above description of the flowchart for the cooling process, the printing process is stopped for a predetermined period of time and the operation speed of the fan 25 is increased during that period of time. However, as described above, the cooling process is not limited to such procedure.

Although the heater H1 is a halogen lamp in the above description, the heater may be a flat plate-shaped heater comprising a substrate and a resistance heating element that contacts an inner peripheral surface of a belt which is the heating member. More than one heater H1 may be provided.

Although the heating member 81 is an endless belt in the above description, the heating member may be a cylindrical heating roller made of metal or the like which can be rotated.

Although an example of a monochrome laser printer is described in the above description, the image forming apparatus may be a color printer, a copy machine, a multifunction machine, etc.

The elements described in the above embodiment and its modified examples may be implemented selectively and in combination.

What is claimed is:

1. An image forming apparatus comprising:

a feed roller that feeds a sheet having a width oriented in a width direction perpendicular to a conveyance direction of the sheet;

a process unit that forms a toner image on the sheet fed from the feed roller;

a fuser that heats and fixes the toner image formed on the sheet; and a controller, wherein the fuser comprises:

a heating member; and a temperature sensor that detects a temperature at an end portion of the heating member which is one of two end portions thereof positioned apart from each other in the width direction, wherein the controller is configured to:

identify a selected sheet size setting as defined by a dimension in the width direction and a dimension in the conveyance direction;

set a cooling threshold at a first threshold if the selected sheet size setting is a first size having a dimension in the width direction larger than a predetermined dimension, and a dimension in the conveyance direction larger than the dimension in the width direction;

set the cooling threshold at a second threshold lower than the first threshold if the selected sheet size setting is a second size having a dimension in the width direction that is the same as the dimension in the width direction of the first size, and a dimension in the conveyance direction smaller than the dimension in the width direction;

execute a printing process by controlling the feed roller, the process unit, and the fuser; and execute, if a temperature detected by the temperature sensor becomes equal to or higher than the cooling threshold during execution of the printing process, a cooling process to restrain a rise in temperature of the heating member.

2. The image forming apparatus according to claim 1, wherein the cooling process includes at least one of temporarily stopping the printing process, reducing a conveyance speed of a sheet during the printing process, setting a spacing between sheets conveyed one after another longer during the printing process, activating a fan of the image forming apparatus, and increasing an operation speed of the fan.

3. The image forming apparatus according to claim 1, wherein the controller is configured to convey, if the selected sheet size setting is the second size, a sheet at a conveyance speed that is the same as a conveyance speed in which a sheet is conveyed when the selected sheet size setting is the first size.

4. The image forming apparatus according to claim 1, wherein the controller is configured to set, if the selected sheet size setting is the second size, a spacing between sheets conveyed one after another longer than a spacing between sheets conveyed one after another as set when the selected sheet size setting is the first size.

5. The image forming apparatus according to claim 1, wherein the controller is configured to convey a sheet at a conveyance speed slower than a conveyance speed in which a sheet is conveyed when the selected sheet size setting is the second size, if the selected sheet size setting is a third size having a dimension in the conveyance direction that is the same as the dimension in the conveyance direction of the second size, and a dimension in the width direction smaller than the dimension in the width direction of the second size.

6. The image forming apparatus according to claim 5, wherein the controller is configured to set, if the selected sheet size setting is the third size, the cooling threshold at the first threshold.

7. The image forming apparatus according to claim 1, wherein the controller is configured to set a target temperature of the heating member according to the selected sheet size setting.

8. The image forming apparatus according to claim 1, further comprising a sheet sensor that detects presence or absence of a sheet passing therethrough, wherein the controller is configured to calculate, based on a period of time the sheet sensor detects presence of the sheet passing therethrough, a dimension of the sheet in the conveyance direction.

9. The image forming apparatus according to claim 8, wherein the controller is configured to, if a dimension LD in the conveyance direction of a sheet detected by the sheet sensor is smaller than a dimension LS in the conveyance direction of the selected sheet size setting:

convey the sheet at a conveyance speed slower than a conveyance speed at which a sheet is conveyed when the dimension LD and the dimension LS are equal; or change a spacing between sheets conveyed one after another.

10. The image forming apparatus according to claim 8, wherein the controller is configured to stop the printing process, if a dimension LD in the conveyance direction of a sheet detected by the sheet sensor is smaller than a dimension LS in the conveyance direction of the selected sheet size setting.

11. The image forming apparatus according to claim 8, wherein the sheet sensor is located at a position in the width direction through which all sizes of sheets usable in the image forming apparatus pass.

12. The image forming apparatus according to claim 1, wherein the controller is configured to execute the printing process in a mode selected from a plurality of modes which comprise:

a normal fixing mode in which a target temperature of the heating member is adjusted to a temperature corresponding to the selected sheet size setting; and a high-temperature fixing mode in which a target temperature of the heating member is set at a temperature higher than the target temperature of the normal fixing mode, wherein, if the high-temperature fixing mode is selected, the cooling threshold is set at a temperature lower than a temperature set as the cooling threshold in the normal fixing mode.

13. The image forming apparatus according to claim 1, wherein the selected sheet size setting is included in a printing job.

14. The image forming apparatus according to claim 1, wherein the first size includes A4 size in a portrait orientation and letter size in the portrait orientation, and the second size is A5 size in a landscape orientation.

15. The image forming apparatus according to claim 1, wherein the heating member is an endless belt.

* * * * *